US012631379B2

(12) United States Patent
Dziubinschi et al.

(10) Patent No.: US 12,631,379 B2
(45) Date of Patent: May 19, 2026

(54) SERVICEABLE ACCUMULATOR WITH INTEGRATED PLATE FIN HEAT EXCHANGER

(71) Applicant: Hanon Systems, Daejeon (KR)

(72) Inventors: Orest Alexandru Dziubinschi, Dearborn, MI (US); Madison Paige Turner, Royal Oak, MI (US); Devon Laird, Commerce Charter Township, MI (US); Jeffrey Laplante, Highland, MI (US)

(73) Assignee: HANON SYSTEMS (KR)

( * ) Notice: Subject to any disclaimer, the term of this patent is extended or adjusted under 35 U.S.C. 154(b) by 246 days.

(21) Appl. No.: 18/503,567

(22) Filed: Nov. 7, 2023

(65) Prior Publication Data

US 2024/0310094 A1 Sep. 19, 2024

Related U.S. Application Data

(60) Provisional application No. 63/489,879, filed on Mar. 13, 2023.

(51) Int. Cl.
*F25B 43/00* (2006.01)

(52) U.S. Cl.
CPC ..... *F25B 43/006* (2013.01)

(58) Field of Classification Search
CPC ..... F25B 43/006; F25B 2339/044; F25B 2339/0441; F25B 2339/0446
See application file for complete search history.

(56) References Cited

U.S. PATENT DOCUMENTS

| | | | | |
|---|---|---|---|---|
| 3,830,077 | A | 8/1974 | Willen et al. | |
| 4,217,765 | A | 8/1980 | Ecker | |
| 4,488,413 | A | 12/1984 | Bottum et al. | |
| 4,611,750 | A * | 9/1986 | Kish | F25B 43/006 228/184 |
| 4,938,037 | A * | 7/1990 | Carlisle, Jr. | F25B 43/006 62/503 |
| 5,184,480 | A | 2/1993 | Kolpacke | |
| 5,201,792 | A | 4/1993 | Study | |
| 5,245,833 | A | 9/1993 | Mei et al. | |

(Continued)

FOREIGN PATENT DOCUMENTS

| | | | |
|---|---|---|---|
| EP | 0837291 | A2 | 4/1998 |
| GB | 2316738 | B | 7/1998 |

*Primary Examiner* — Miguel A Diaz
(74) *Attorney, Agent, or Firm* — Shumaker, Loop & Kendrick, LLP; James D. Miller

(57) ABSTRACT

An accumulator and heat exchanger assembly includes a heat exchanger having first flow passages and second flow passages formed therein, the first flow passages configured to convey a first flow of a fluid therethrough and the second flow passages configured to convey a second fluid flow therethrough with the first flow and the second fluid flow fluidly separated from one another within the heat exchanger. An accumulator includes a can and a cap removably coupled to the can. An interior of the can is configured to convey the second fluid flow therethrough to separate a liquid portion thereof from a vapor portion thereof and/or to remove moisture therefrom. The heat exchanger is coupled to the cap and is removable from the can therewith such that removal of the cap and the heat exchanger from the can provides access to the interior of the can.

18 Claims, 7 Drawing Sheets

(56) References Cited

U.S. PATENT DOCUMENTS

| | | | | |
|---|---|---|---|---|
| 5,289,699 | A | 3/1994 | Nivens | |
| 5,457,966 | A | 10/1995 | Nivens | |
| 5,622,055 | A | 4/1997 | Mei et al. | |
| 5,729,998 | A | 3/1998 | Grohs et al. | |
| 5,832,736 | A | 11/1998 | Yoshioka et al. | |
| 11,058,980 | B2 | 7/2021 | Zapletal | |
| 2003/0024266 | A1 | 2/2003 | Zhang et al. | |
| 2008/0000261 | A1* | 1/2008 | Klotten | F25B 40/00 62/503 |
| 2011/0083468 | A1 | 4/2011 | Bellenfant et al. | |

* cited by examiner

SERVICEABLE ACCUMULATOR WITH INTEGRATED PLATE FIN HEAT EXCHANGER

CROSS-REFERENCE TO RELATED APPLICATION

This patent application claims priority to U.S. Provisional patent application Ser. No. 63/489,879, filed on Mar. 13, 2023, the entire disclosure of which is hereby incorporated herein by reference.

FIELD OF THE INVENTION

The present invention relates generally to air conditioning systems for motor vehicles, and, more particularly, to an accumulator with an integral heat exchanger for an air conditioning system of a motor vehicle.

BACKGROUND OF THE INVENTION

A basic refrigeration or air conditioning system has a compressor, a condenser, an expansion device, and an evaporator. These components are generally serially connected via conduit or piping and are well known in the art. During operation of the system, the compressor acts on relatively cool gaseous refrigerant to raise the temperature and pressure of the refrigerant. From the compressor, the high temperature, high pressure gaseous refrigerant flows into the condenser where it is cooled and exits the condenser as a high pressure liquid refrigerant. The high pressure liquid refrigerant then flows to an expansion device, which controls an amount of refrigerant entering into the evaporator. The expansion device lowers the pressure of the liquid refrigerant before allowing the refrigerant to flow into the evaporator. In the evaporator, the low pressure, low temperature refrigerant absorbs heat from the surrounding area and exits the evaporator as a saturated vapor having essentially the same pressure as when it entered the evaporator. The suction of the compressor then draws the gaseous refrigerant back to the compressor where the cycle begins again.

In a typical air conditioning or refrigeration system, it is necessary to prevent liquid from passing from the evaporator into the compressor in order to avoid damage to the compressor. When liquid refrigerant enters a compressor, it is known as slugging. Slugging reduces the overall efficiency of the compressor and can also damage the compressor. It is well known in the art to mount a suction line or low pressure side accumulator between the evaporator and compressor. Such suction line accumulators act to separate the liquid and gaseous phases of the refrigerant flowing from the evaporator. The liquid portion of the refrigerant will settle to the bottom of the accumulator while the gaseous phase will rise to the top of the accumulator and will be suctioned out of the accumulator by the compressor. Examples of such accumulators are disclosed in U.S. Pat. Nos. 5,184,480; 5,201,792; and 5,729,998, the entire contents of each of which are incorporated herein by reference.

It is also known in the art to have an accumulator with a heat exchanger arranged on both the high pressure and low pressure sides of an air conditioning or refrigeration system. In general, high pressure, high temperature refrigerant exits a compressor and flows into a condenser. The high temperature liquid refrigerant exits the condenser and flows into a heat exchanger located in an accumulator. The refrigerant is discharged from the accumulator and flows into an expansion device and subsequently into an evaporator.

At the same time, low temperature, low pressure refrigerant flowing from the evaporator enters the accumulator and the liquid phase settles to the bottom of the accumulator, and the gaseous phase rises. The low temperature gaseous refrigerant then flows through the heat exchanger where it comes in contact with the high pressure, high temperature liquid refrigerant from the condenser in a heat exchange relationship. The high pressure liquid from the condenser is then cooled by the low pressure, low temperature gaseous refrigerant running simultaneously through the heat exchanger. As a result, the liquid refrigerant flowing from the condenser to the evaporator is cooled and can thereby absorb more heat as it flows through the evaporator. The gaseous refrigerant exiting the low pressure side of the heat exchanger is higher in temperature having absorbed heat from the high pressure, high temperature liquid refrigerant. As a result, any liquid refrigerant that may remain in the low pressure, low temperature refrigerant will be converted into a gas in the heat exchanger, thereby reducing the risk of having liquid flow into the compressor.

U.S. Pat. Nos. 5,622,055; 5,245,833; 4,488,413; and 4,217,765 and U.S. Pat. Appl. Pub. No. 2003/0024266, the entire contents of each of which are incorporated herein by reference, disclose accumulators with internal heat exchangers. In these patents, high pressure, high temperature refrigerant from the condenser is cooled as it flows through a tube that is sitting in a pool of low temperature liquid refrigerant that has been discharged from the evaporator and collected in the accumulator.

GB Patent No. 2316738B, the entire contents of which are incorporated herein by reference, also discloses a low pressure side accumulator with an internal heat exchanger. The accumulator is divided into an upper and lower chamber. The heat transfer unit, two serially connected tubes, is housed in the lower chamber. High temperature, high pressure refrigerant flowing from the condenser enters one end of the tubes and exits the other end and then flows to an expansion device evaporator. At the same time, low pressure, low temperature refrigerant from the evaporator is discharged into the upper chamber. The refrigerant in the upper chamber is drawn into the lower chamber where it flows through the lower chamber in a heat exchange relationship with high pressure, high temperature refrigerant flowing through the tubes before being discharged from the accumulator and drawn back to the compressor.

U.S. Pat. Nos. 5,457,966 and 5,289,699, the entire contents of each of which are incorporated herein by reference, disclose a high pressure side accumulator with an internal heat exchanger. In one embodiment, the heat exchanger comprises an outer shell with right and left end plates and an outer tube with a cutaway portion located within the shell. An inner tube is housed within the outer tube and extends through the shell and both end plates. In operation, high pressure, high temperature liquid refrigerant from the condenser enters an inlet line, which flows into the outer tube. The liquid refrigerant flows through the outer tube and into the shell at the cut away portion. The liquid refrigerant is discharged from the shell through an outlet line. At the same time, low pressure, low temperature refrigerant from the evaporator enters the smaller tube and flows through the inner tube in a heat exchange relationship with the high pressure, high temperature refrigerant before flowing back to the compressor. In a second embodiment, the heat exchanger housed within the shell comprises a small oval shaped tube affixed to one side of a large tube. The larger tube extends through the entire length of the shell. High pressure, high temperature liquid refrigerant from the condenser enters one end of the oval shaped tube and exits the other end and flows into the shell. Liquid refrigerant exits the shell through an outlet line and flows to the evaporator. Simultaneously, low pressure, low temperature refrigerant flows from the evaporator through the large tube in a heat exchange relationship with the high pressure, high temperature refrigerant. The low pressure, low temperature refrigerant exiting the larger tube flows back to the compressor. A third embodiment is similar to the second embodiment except that the smaller tube is spirally wrapped around the outside of the larger tube.

U.S. Pat. No. 3,830,077, the entire contents of which are incorporated herein by reference, discloses a heat exchanger for use in a vehicle, which is connected between the evaporator and compressor. The heat exchanger comprises an outer shell with low pressure, low temperature inlet and outlet lines and at least one heat exchange coil, with an inlet end an outlet end both extending through the shell. In operation, low pressure, low temperature refrigerant enters the inlet line, flows through the shell, exits the outlet line and flows back to the compressor. At the same time a high temperature vehicle fluid flows through the coil in a heat exchange relationship with the low temperature, low pressure refrigerant. The patent does not specifically disclose connecting the heat exchange coil to the high pressure, high temperature side of the air conditioning system.

Finally, published EP Patent Application No. EP 0837291A2, the entire contents of which are incorporated herein by reference, discloses the use of a sub cooling circuit to cool high pressure, high temperature carbon dioxide refrigerant in a vehicle air conditioning system. The sub cooling circuit is located between the condenser and main expansion device and comprises a subpressure reducer and a heat exchanger. In operation, the high pressure, high temperature carbon dioxide refrigerant from the condenser is split into two flows, the first flow flows into the sub cooling circuit where it is cooled by passing through the pressure reducer before flowing through the heat exchanger. The second flow of refrigerant passes directly through the heat exchanger where it is cooled by the first flow.

While the above accumulators and heat exchangers are suitable for their intended purpose, it is believed that there is a demand in the industry for an improved accumulator with an internal heat exchanger, especially one that can withstand the higher pressure requirements of an air conditioning or refrigeration system employing carbon dioxide as a refrigerant. It is further believed that there is a demand for an improved accumulator with an internal heat exchanger that is compact, easily assembled, lighter weight, and less costly to manufacture, but yet provides a high level of efficiency.

In the refrigerant A/C system, a desiccant bag of the accumulator absorbs moisture and contaminants to protect against humidity and reduce corrosion risk. It is now desirable for the accumulator desiccant bag to be serviceable without removing the assembly from the vehicle. Currently, accumulators do not allow for the desiccant bag to be serviceable because the accumulator cap and can are pressed and welded during manufacturing. Additionally, modular thermal management systems require components (i.e. plate-fin heat exchangers & accumulator) to be packaged in a restricted space, presenting challenges for off-the-shelf components to be packaged successfully.

It would be desirable to produce an accumulator and a heat exchanger where a desiccant bag of the accumulator is serviceable and a packaging space of the accumulator and the heat exchanger is minimized.

SUMMARY OF THE INVENTION

Consistent and consonant with the present invention, an accumulator and a heat exchanger where a desiccant bag of the accumulator is serviceable and a packaging space of the accumulator and the heat exchanger is minimized, has surprisingly been discovered.

In one embodiment, an accumulator and heat exchanger assembly includes a heat exchanger having first flow passages and second flow passages formed therein, the first flow passages configured to convey a first flow of a fluid therethrough and the second flow passages configured to convey a second fluid flow therethrough with the first flow and the second fluid flow fluidly separated from one another within the heat exchanger. An accumulator includes a can and a cap removably coupled to the can. An interior of the can is configured to convey the second fluid flow therethrough to separate a liquid portion thereof from a vapor portion thereof and/or to remove moisture therefrom. The heat exchanger is coupled to the cap and is removable from the can therewith such that removal of the cap and the heat exchanger from the can provides access to the interior of the can.

According to another embodiment of the invention, a thermal management system comprises a refrigerant circuit including, in an order of flow of a refrigerant through the refrigerant circuit, a compressor, a condenser, a high-pressure side of an internal heat exchanger, an expansion element, an evaporator, an accumulator, and a low-pressure side of the internal heat exchanger. The high-pressure side of the internal heat exchanger includes first flow passages formed therein and the low-pressure side of the internal heat exchanger includes second flow passages formed therein. The first flow passages are configured to convey a first flow of the refrigerant therethrough and the second flow passages are configured to convey a second flow of the refrigerant therethrough. The first flow of the refrigerant and the second flow of the refrigerant are fluidly distinct from one another within the internal heat exchanger. The accumulator includes a can and a cap removably coupled to the can. An interior of the can is configured to convey the second flow of the refrigerant therethrough to separate a liquid portion thereof from a vapor portion thereof and/or to remove moisture therefrom. The internal heat exchanger is coupled to the cap and is removable from the can therewith. Removal of the cap and the internal heat exchanger from the can provides access to the interior of the can.

BRIEF DESCRIPTION OF THE DRAWINGS

The above advantages of the invention will become readily apparent to those skilled in the art from reading the following detailed description of an embodiment of the invention in the light of the accompanying drawings, in which.

DETAILED DESCRIPTION OF THE PREFERRED EMBODIMENT

Figure 1:
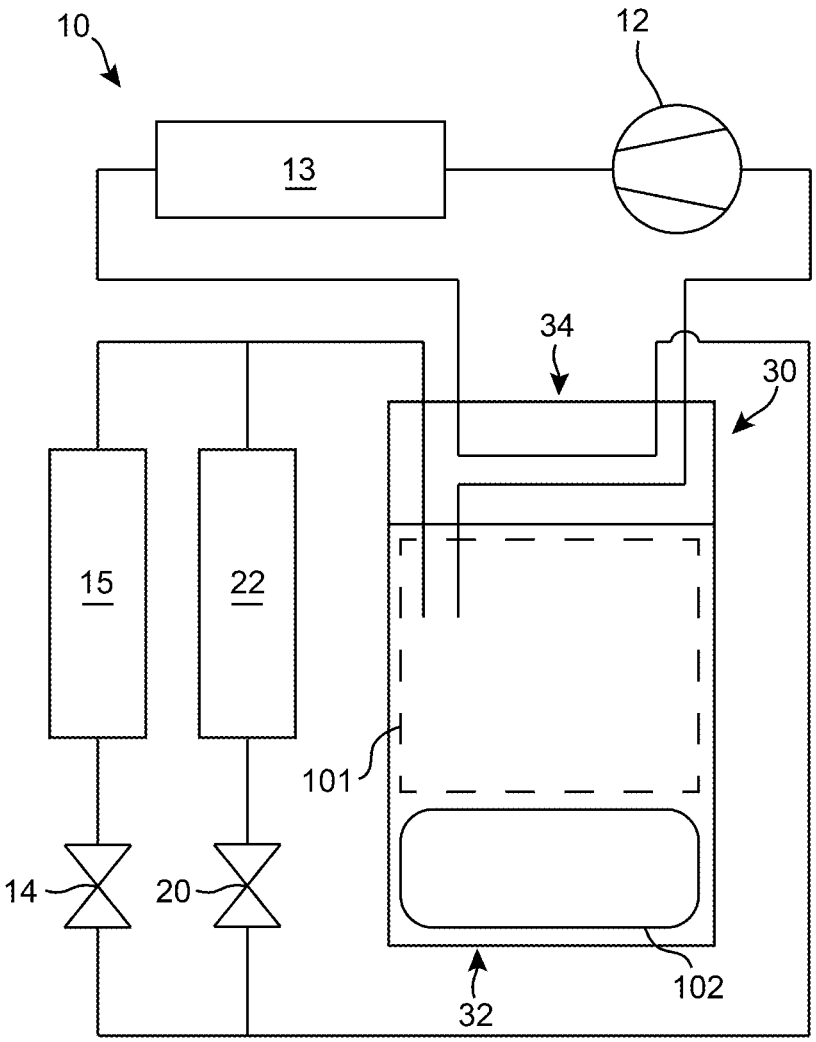
FIG. 1 is a schematic illustration of a refrigerant circuit including an integrated accumulator and internal heat exchanger according to an embodiment of the present disclosure.
Figure 2:
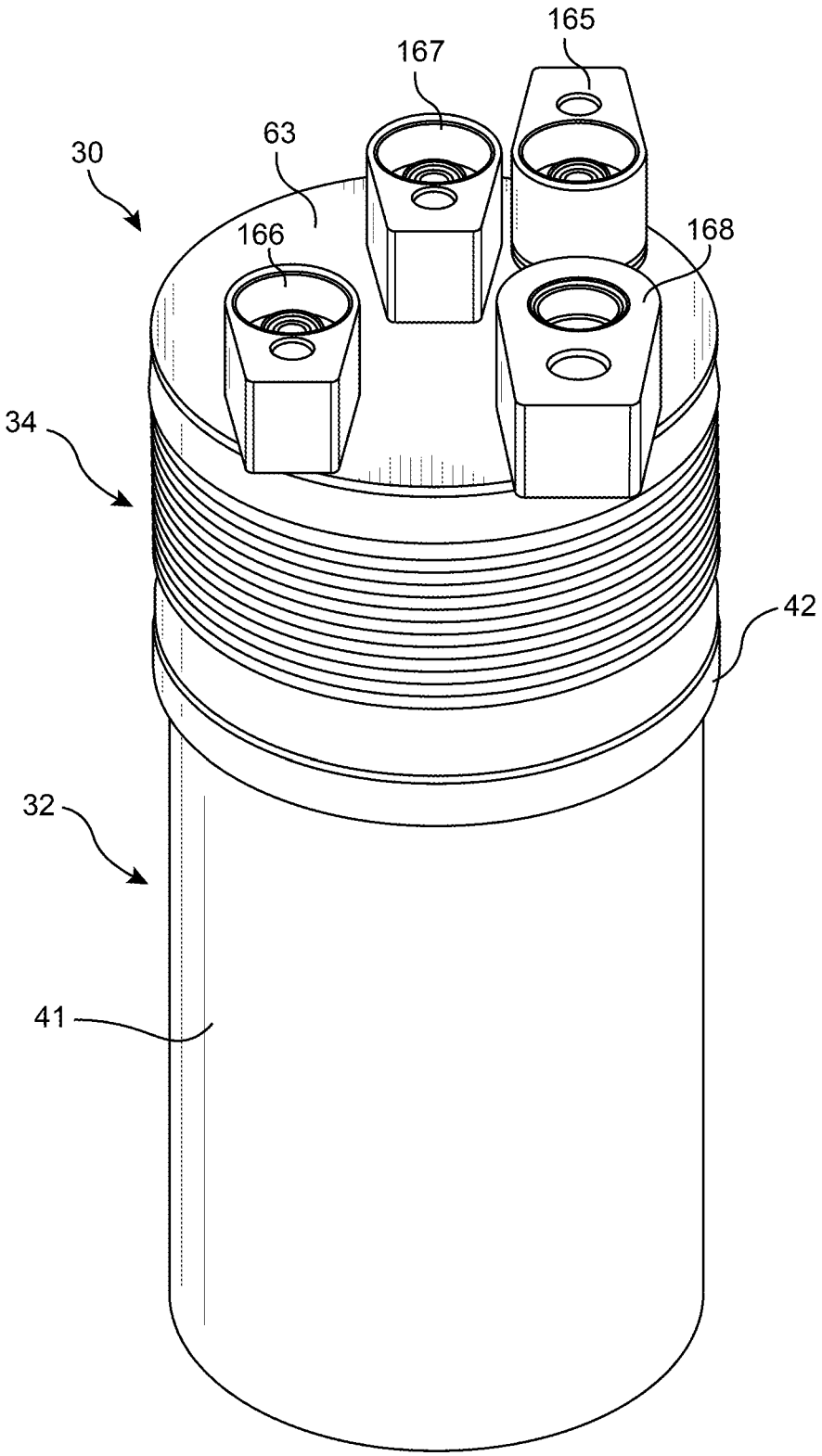
FIG. 2 is a front perspective view of the integrated accumulator and internal heat exchanger of FIG. 1.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 illustrates a refrigerant circuit 10 having an accumulator assembly 30 according to an embodiment of the present invention, wherein the accumulator assembly 30 includes an accumulator 32 and an integrated internal heat exchanger 34 for forming a single modular component of the refrigerant circuit 10. The refrigerant circuit 10 may form a portion of a thermal management system of a vehicle. The vehicle may be a hybrid or electric vehicle relying upon stored electrical power to provide heat to various components of the vehicle as well as the air to be delivered to the passenger cabin of the vehicle via the operation of the thermal management system and the corresponding refrigerant circuit 10, although the present invention is not necessarily limited to use in such a vehicle.

The refrigerant circuit 10 includes at least a compressor 12, a condenser 13, the accumulator assembly 30, an expansion element 14, and an evaporator 15. The refrigerant circuit 10 is shown in substantially simplified schematic form in FIG. 1 and may include additional flow paths, valves, and/or components from those described or illustrated without necessarily departing from the scope of the present invention, so long as the same relationships are present within the refrigerant circuit 10 for prescribing operation thereof in the manner described hereinafter, and especially with regards to the operation of the disclosed accumulator assembly 30 and associated components thereof. Potential variations are described hereinafter in describing the components forming the refrigerant circuit 10.

The compressor 12 is configured to increase a pressure and temperature of the refrigerant while in a gaseous state. The condenser 13 is a heat exchanger configured to remove heat from the high-temperature and high-pressure refrigerant exiting a high-pressure side of the compressor 12. The refrigerant exiting the condenser 13 may be partially liquid and partially gaseous in phase. The condenser 13 may be in heat exchange communication with any other fluid suitable for removing heat from the refrigerant within the condenser 13. In some embodiments, the condenser 13 may be a water-cooled condenser (WCC) in fluid communication with a liquid coolant of an associated fluid system of the vehicle, such as a coolant system utilized in cooling various components of the vehicle. In other embodiments, the condenser 13 may be a radiator configured to exchange heat with ambient air. In still other embodiments, the condenser 13 may be a heating heat exchanger disposed within an HVAC casing (not shown) of the vehicle, and may be configured to heat air delivered to a passenger compartment of the vehicle.

Although now illustrated in FIG. 1, the refrigerant circuit 10 may further include a secondary condenser arranged in a parallel flow arrangement or a series flow arrangement relative to the condenser 13 for aiding in employing multiple different modes of operation of the refrigerant circuit 10. For example, the refrigerant passing through the condenser 13 may be in heat exchange communication with the flow of air to be delivered to the passenger compartment of the vehicle while the refrigerant passing through the secondary condenser may be in heat exchange communication with the alternatively described coolant or flow of ambient air, as one non-limiting combination of possible heat exchanging configurations. A valve arrangement (not shown) may determine a flow configuration of the refrigerant through each of the condensers, where utilized, when the refrigerant circuit 10 is switched between the different modes of operation thereof.

The expansion element 14 may refer to any structure or device for contracting and then expanding a flow of the refrigerant therethrough such that a temperature and a pressure of the refrigerant are each lowered following passage through the expansion element 14. The expansion element 14 is accordingly configured to lower a temperature and a pressure of the refrigerant passing therethrough prior to entry into the evaporator 15 and following passage through a high-pressure side of the internal heat exchanger 34 of the accumulator assembly 30. The expansion element 14 may be referred to as the primary expansion element.

The expansion element 14 may be a fixed orifice or may be an adjustable expansion device wherein a flow cross-section through the expansion element 14 may be varied to alter the drop in pressure and temperature of the refrigerant passing therethrough. In some embodiments, the expansion element 14 may be further associated with a shut-off valve (not shown) or may be adjustable to a fully closed position wherein refrigerant cannot pass therethrough, thereby preventing the flow of the refrigerant through the downstream arranged evaporator 15. If provided as an adjustable expansion device, the expansion element 14 may be an electronic expansion valve (EXV) where the flow cross-section through the expansion element 14 is electronically controlled according to an associated control scheme, which may include being adjusted to a fully closed position. The expansion element 14 may alternatively be provided as a thermal expansion valve (TXV) where a temperature of the refrigerant encountering the TXV controls a flow cross-section through the TXV, such as increasing or decreasing the flow cross-section in reaction to an increasing or decreasing temperature of the refrigerant, as the circumstances may warrant. The TXV may also be configured to be adjustable to fully close off flow therethrough, as conditions may warrant based on the configuration of the TXV and the operating parameters thereof.

The evaporator 15 is a heat exchanger configured to add heat to the high-temperature and high-pressure refrigerant entering the compressor 12 with the refrigerant exiting the evaporator 15 being gaseous in phase. The evaporator 15 may be in heat exchange communication with any other fluid suitable for removing heat from the refrigerant within the evaporator 15. In some embodiments, the evaporator 15 may be a cooling heat exchanger disposed within the HVAC casing (not shown) of the vehicle, and may be configured to cool and/or dehumidify air delivered to a passenger compartment of the vehicle. In other embodiments, the evaporator 15 may be configured to cool a fluid or structural component associated with operation of the vehicle, and may alternatively be referred to as a chiller in such circumstances.

The refrigerant circuit 10 is shown in FIG. 1 as further including a secondary expansion element 20 and a chiller 22. The secondary expansion element 20 and the chiller 22 may be disposed in a parallel flow configuration relative to the expansion element 14 and the evaporator 15 such that the refrigerant may flow through the expansion element 14 and the evaporator 15 and/or the secondary expansion element 20 and the chiller 22, depending on the desired operation of the refrigerant circuit 10. It should accordingly be understood that references hereinafter to a flow of the refrigerant through the expansion element 14 and the evaporator 15 may alternatively refer to the refrigerant being distributed to flow through each of the evaporator 15 via the expansion element 14 and the chiller 22 via the secondary expansion 20, or may refer to the refrigerant being exclusively distributed to flow through the chiller 22 via the secondary expansion element 20 absent flow through the evaporator 15, without necessarily departing from the scope of the present invention. It should also be understood that components being described as upstream or downstream of the expansion element 14 and the evaporator 15 are also similarly disposed upstream or downstream of the secondary expansion element 20 and the chiller 22 in the same manner.

In some embodiments, the refrigerant circuit 10 may include the branching of the refrigerant to three or more of the evaporators/chillers at the disclosed position, as necessary, to prescribe the desired cooling to each component or fluid of the associated thermal management system. For example, the additional branches of the primary circuit may each be associated with a chiller directly or indirectly (via an intervening fluid) cooling a different electronic component of the vehicle. In other embodiments, the refrigerant circuit 10 may include only the expansion element 14 and the evaporator 15, as desired, in the absence of any form of branching at the illustrated position on the refrigerant circuit 10. The secondary expansion element 20 and any other expansion element associated with any additional chillers and/or evaporators branching from the primary circuit may be provided as any of the examples given with respect to the expansion element 14, including being a fixed orifice, an EXV, or a TXV, as non-limiting examples.

As explained in greater detail hereinafter when describing the structure of the accumulator assembly 30, the internal heat exchanger 34 integrated therein includes a high-pressure side and a low-pressure side, each of which correspond to different and fluidly distinct fluid flow paths through the internal heat exchanger 34. The high-pressure side conveys the refrigerant after having exited the condenser 13 and prior to entry into a corresponding one of the expansion elements 14, 20 and the low-pressure side conveys the refrigerant after exiting the corresponding evaporator/chiller 15, 22 and prior to entry into a low-pressure side of the compressor 12.

The internal heat exchanger 34 is accordingly configured to provide heat exchange communication between a high-pressure portion of the refrigerant at a position upstream of the expansion member 14, 20 and the evaporator 15, 22 and a low-pressure portion of the refrigerant at a position downstream of the expansion member 14, 20 and the evaporator 15, 22. The high-pressure portion of the refrigerant has a relatively greater temperature than the low-pressure portion of the refrigerant at the internal heat exchanger 34, hence the heat exchange occurring via the internal heat exchanger 34 causes a temperature of the high-pressure portion of the refrigerant to be decreased and also causes a temperature of the low-pressure portion of the refrigerant to be increased. The decreasing of the temperature of the high-pressure portion of the refrigerant may lead to a subcooling of the high-pressure portion of the refrigerant below the saturation temperature thereof, which in turn leads to a cooling capacity of whichever evaporator 15 or chiller 22 is passed by the refrigerant, depending on the desired operating mode of the refrigerant circuit 10, being increased via the heat exchange occurring within the internal heat exchanger 34 in comparison to a refrigerant circuit devoid of such heat exchange. The low-pressure portion of the refrigerant may also be superheated to a temperature above the evaporation temperature of the refrigerant via the heat exchange occurring within the internal heat exchanger 34.

Referring now to FIGS. 2-7, the accumulator 32 of the accumulator assembly 30 includes a can 41 and a removable cap 42 having the internal heat exchanger 34 non-removably coupled thereto to integrate the internal heat exchanger 34 into the structure of the removable cap 42. The can 41 is substantially cylindrical in shape and extends axially from an open first end 43 to an opposing closed second end 44 with an inner surface of the can 41 defining a hollow interior 45 thereof. The closed second end 44 may include a substantially spherical or otherwise rounded shape, as desired.

Figure 7:
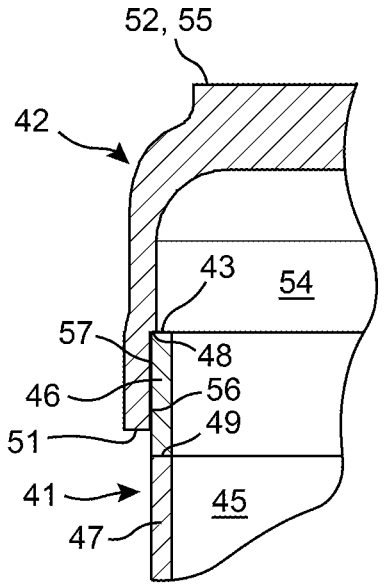
FIG. 7 is an enlarged fragmentary view showing an interface of the integrated accumulator and internal heat exchanger wherein a cap structure having internal threads is removably coupled to a can structure having external threads.

As best shown in FIG. 7, the can 41 may be formed by joining an annular collar 46 to an exposed axial end surface at an open end of a circumferential wall 47 of the can 41. The annular collar 46 may be aggressively joined to the circumferential wall 47 via an aggressive joining process. Where the wall 47 and the collar 46 are formed from metallic materials, aggressive joining processes such as welding or brazing may be employed, as non-limiting examples. If polymeric (plastic) materials are utilized, then a press-fit or heat-welding process may be utilized. The annular collar 46 may accordingly be non-removably coupled to the circumferential wall 47 about a perimeter thereof to cause the open first end 43 of the can 41 to be formed by an exposed axial end of the annular collar 46 formed opposite a seam 49 where the annular collar 46 is joined to the circumferential wall 47.

The cap 42 extends axially from an open first end 51 thereof to an oppositely arranged closed second end 52 thereof. An inner surface of the cap 42 defines a hollow interior 54 thereof, which is configured to be disposed co-extensive with the hollow interior 45 of the can 41 when the cap 42 is removably coupled to the can 41. An end surface 55 of the cap 42 including the closed second end 52 thereof is configured to be coupled, non-removably, to the internal heat exchanger 34.

Referring again to FIG. 7, the cap 42 may be removably coupled to the can 41 via threaded engagement therebetween, thereby allowing for the cap 42 to be axially advanced or retracted relative to the can 41 via appropriate rotational motion of the cap 42 relative to the can 41. In the embodiment shown in FIGS. 2-7, the open first end 51 of the cap 42 is radially enlarged relative to the open first end 43 of the can 41 such that the cap 42 is axially received over the can 41 when removably coupled thereto, with an inner threaded portion 56 of the open first end 51 of the cap 42 configured to threadably engage an outer threaded portion 57 of the open first end 43 of the can 41. The outer threaded portion 57 of the open first end 43 is formed within the annular collar 46 thereof, hence the threading of the outer threaded portion 57 may be performed prior to the assembly of the annular collar 46 to the original end surface of the circumferential wall 47. The inner surface of the cap 42 may further define a shoulder 48 against which the open first end 43 of the can 41 abuts for establishing maximum axial insertion of the can 41 into the cap 42.

Figure 8:
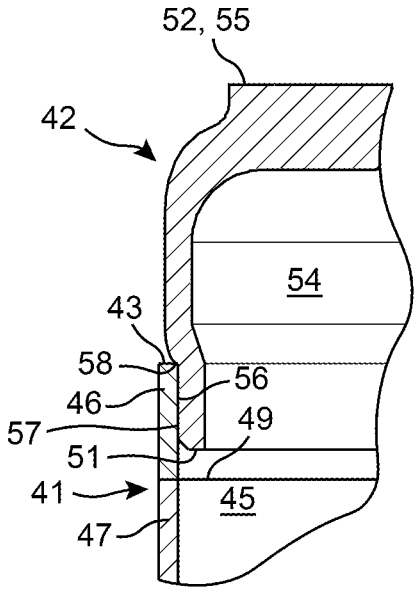
FIG. 8 is an enlarged fragmentary view showing an interface of the integrated accumulator and internal heat exchanger wherein a cap structure having external threads is removably coupled to a can structure having internal threads.

Referring briefly to FIG. 8, a slight variation of the configuration of the can 41 and the cap 42 is disclosed that includes a reversal of the threading of the can 41 and the cap 42 in comparison to the embodiment of FIGS. 2-7, but otherwise may be manufactured and may operate in the same manner thereas, such as including the use of independently provided and subsequently coupled collar 46 at the open first end 43 of the can 41 and the use of relative rotational motion of the cap 42 relative to the can 41 for facilitating axial advancement of retraction of the cap 42 relative to the can 41. Specifically, the open first end 51 of the cap 42 is now tapered radially inwardly to result in the open first end 51 of the cap 42 being received axially within the open first end 43 of the can 41 with the inner threaded portion 56 now disposed at the open first end 43 of the can 41 and the outer threaded portion 57 now disposed at the open first end 51 of the cap 42. An outer surface of the cap 42 may include a shoulder 58 disposed at an axial end of the outer threaded portion 57 spaced apart from the open first end 51 of the cap 42 to define an end of the axial insertion of the cap 42 into the can 41.

The hollow interior 45 of the can 41 receives each of a liquid separating device 101 and a drying element 102 therein. In some embodiments, the liquid separating device 101 and/or the drying element 102 are coupled to or otherwise integrated into the structure of the cap 42 of the accumulator assembly 40 such that the corresponding liquid separating device 101 and/or drying element 102 may be removable from the can 41 during removal of the cap 42 therefrom. In other embodiments, one or both of the liquid separating device 101 and/or the drying element 102 may be disposed within the hollow interior 45 without being directly coupled to or otherwise integrated into the structure of the cap 42. Such a circumstance may result in the removal of the cap 42 facilitating access to the interior of the can 41 for accessing the corresponding liquid separating device 101 and/or drying element 102 disposed therein for repairing or maintaining the liquid separating device 101 and/or the drying element 102 within the interior 45 of the can 41, for allowing for the independent removal of one or both of the liquid separating device 101 and/or the drying element 102 from the interior 45 of the can 41 for exterior repair or maintenance, or for facilitating the replacement of one or both of the liquid separating device 101 and the drying element 102 within the hollow interior 45 of the can 41. The cap 42 may accordingly include one or both of the liquid separating device 101 and the drying element 102 being removably coupled thereto, whereas the cap 42 is then in turn removably coupled to the can 41.

Figure 4:
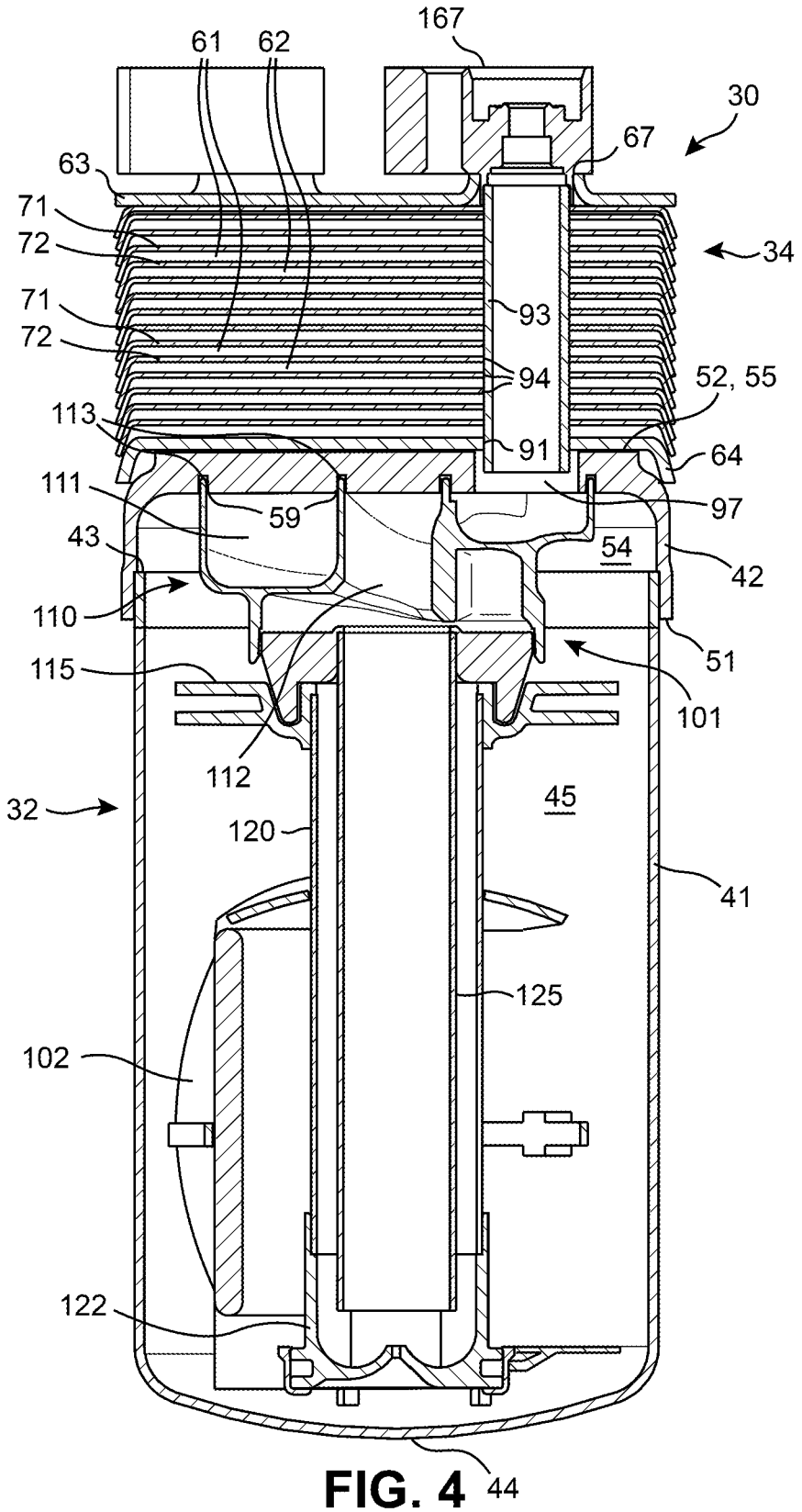
FIG. 4 is an elevational cross-sectional view of the integrated accumulator and internal heat exchanger from the perspective of section lines 4-4 in FIG. 3.
Figure 5:
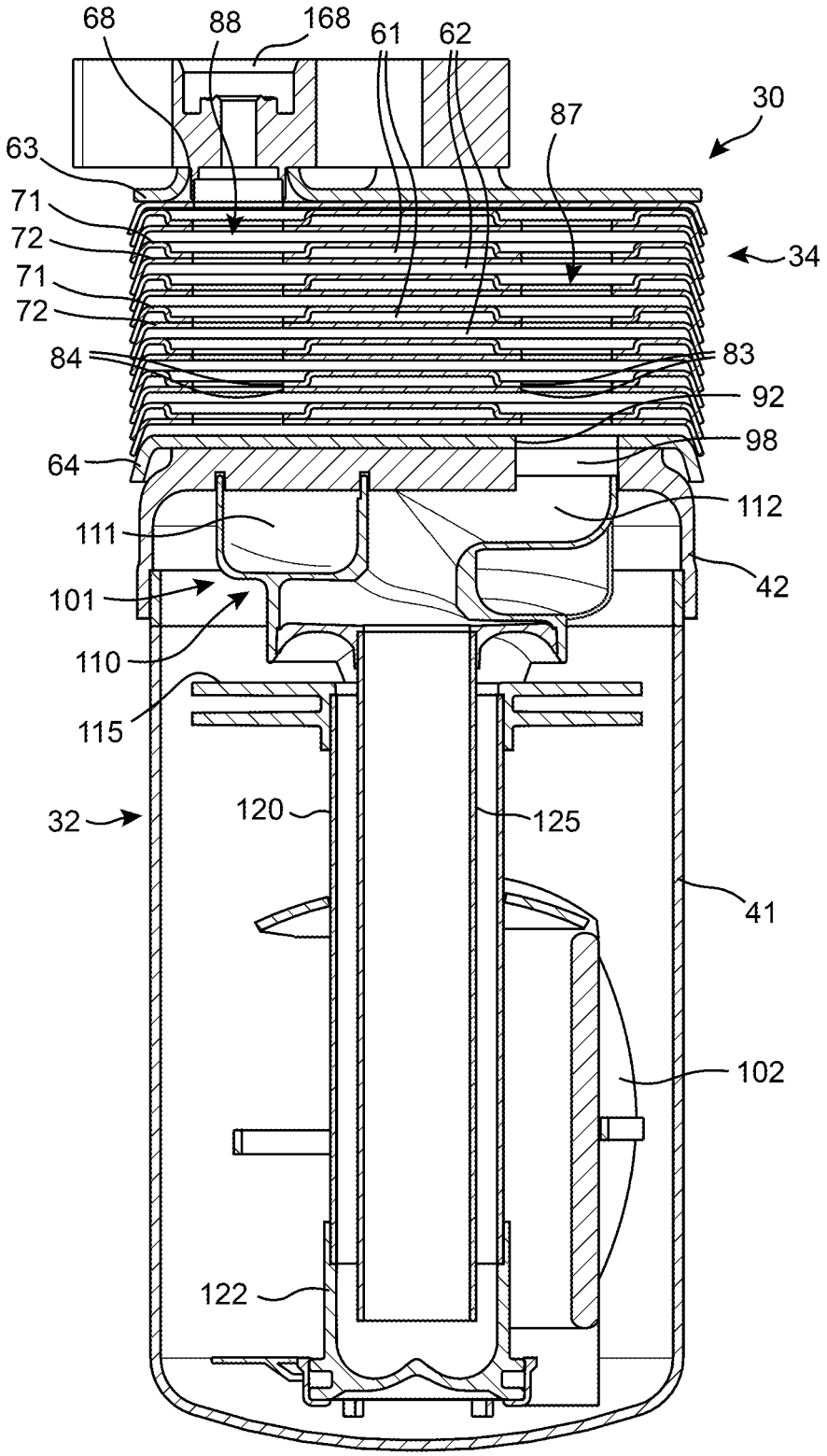
FIG. 5 is an elevational cross-sectional view of the integrated accumulator and internal heat exchanger from the perspective of section lines 5-5 in FIG. 3.
Figure 6:
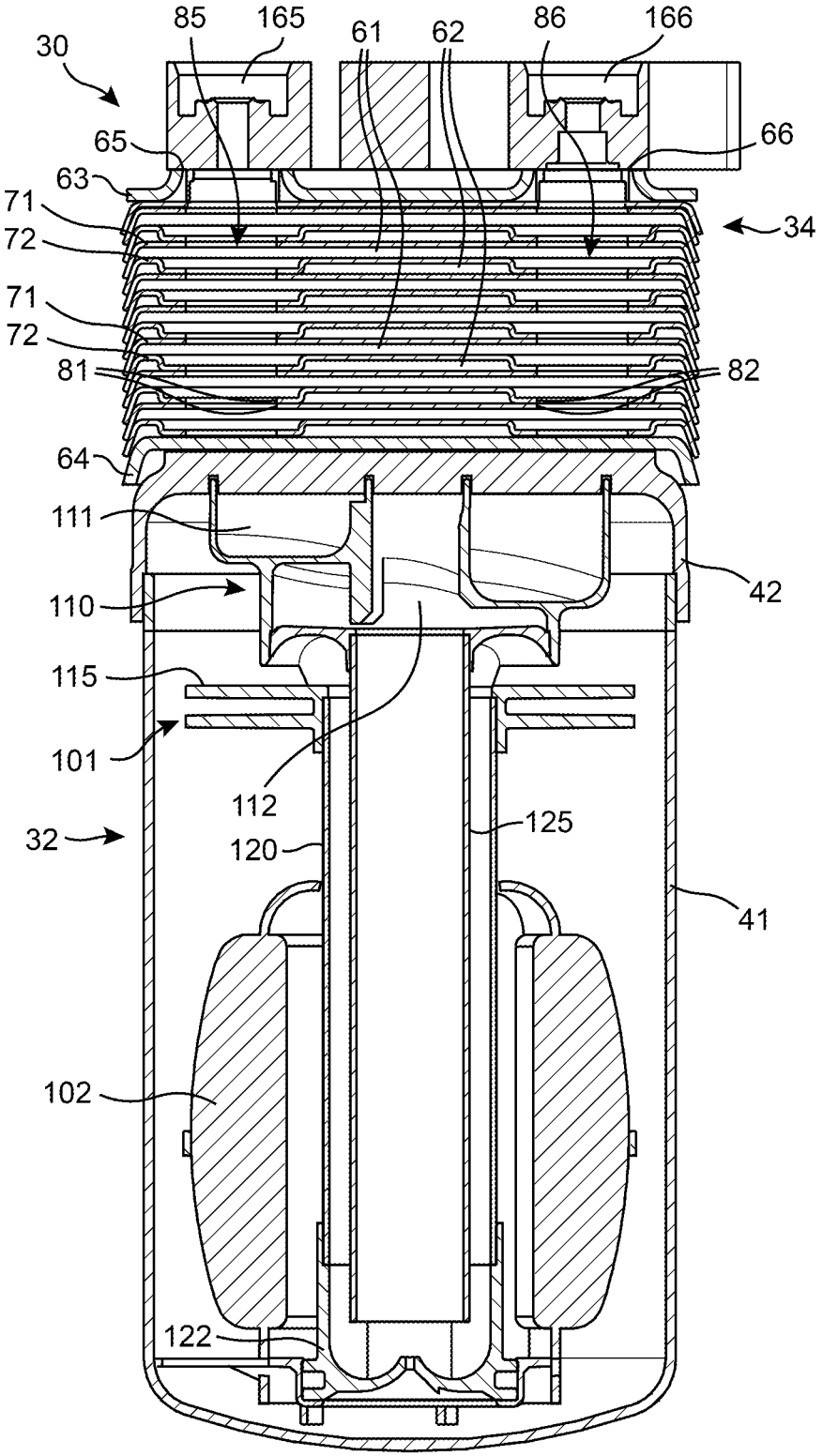
FIG. 6 is an elevational cross-sectional view of the integrated accumulator and internal heat exchanger from the perspective of section lines 6-6 in FIG. 3.

As shown throughout FIGS. 4-6, the accumulator 32 is a cyclone type accumulator, although other accumulator types or configurations may be utilized in conjunction with the integration of the cap 42 and the internal heat exchanger 34 into a common structure while remaining within the scope of the present invention. An example of a cyclone type accumulator is shown and described in U.S. Pat. No. 11,058,980, the entire contents of which are incorporated herein by reference.

The liquid separating device 101 of the cyclone type accumulator 32 includes a flow control structure 110 having an inlet pathway 111 and an outlet pathway 112 formed therein, a flow deflector 115, an outer pipe 120, a turnaround structure 122, and an inner pipe 125. The inlet pathway 111 of the flow control structure 110, which may be referred to as a cyclone of the accumulator 32, defines a substantially spiral or helical flow path of the refrigerant entering the accumulator 32, which may be a combination of vapor and liquid upon entry into the inlet pathway 111. The spiral or helical flow path formed by the inlet pathway 111 causes the refrigerant to change in direction at a tangent to the curvature of the inlet pathway 111 to cause a separation of the liquid portion of the refrigerant from the vapor portion of the refrigerant. The refrigerant enters the hollow interior 45 of the can 41 while flowing tangentially towards an inner surface of the can 41 following passage through the inlet pathway 111.

The flow deflector 115 is substantially cylindrical in shape and is disposed beneath and axially spaced apart from an outlet from the inlet pathway 111. The liquid portion of the refrigerant separated out from the vapor portion is caused to flow radially outwardly beyond the flow deflector 115 for collection within a bottom portion of the can 41 at the second end 44 thereof. The outer pipe 120 is disposed within a central opening of the flow deflector 115 and extends downwardly therefrom. The inner pipe 125 is disposed concentrically within the outer pipe 120, and a lower end of the inner pipe 125 is spaced axially above a lower end of the outer pipe 120. A lower end of the outer pipe 120 is further coupled to a turnaround structure 122 to form an axial turn-around of the vapor portion of the refrigerant at the lower ends of the pipes 120, 125. The configuration of the deflector 115, the outer pipe 120, the turnaround structure 122, and the inner pipe 125 accordingly allows for the vapor portion of the refrigerant to flow above or over the deflector 115, through an upper end of the outer pipe 120, downwardly between the outer pipe 120 and the inner pipe 125, and then upwardly within the inner pipe 125 after having changed directions axially at the lower ends of the pipes 120, 125 when encountering the turnaround structure 122. In some embodiments, the lower end of the outer pipe 120 may further include a means for enriching the refrigerant with oil (not shown), as desired.

The upper end of the inner pipe 125 is coupled to the flow control structure 110 along a central axis of the can 41 of the accumulator 32. The flow deflector 115 may also be coupled to a lower end of the flow control structure 110 to integrate the flow control structure 110, the flow deflector 115, and the assembly of the pipes 120, 125 into a common structure. The upper end of the inner pipe 125 also provides fluid communication between the interior of the inner pipe 125 and the outlet pathway 112 of the flow control structure 110. The outlet pathway 112 extends radially outwardly from the central axis of the can 41 to convey the vapor portion of the refrigerant out of the accumulator 32 following the separation of the liquid portion therefrom.

The drying element 102 of the present embodiment is disclosed as a desiccant bag 102 configured to remove moisture (water) and contaminants from the refrigerant encountering the desiccant bag 102 within the interior 45 of the can 41. As shown throughout FIGS. 4-6, the desiccant bag 102 may be disposed at or adjacent the lower disposed second end 44 of the can 41 and may extend at least partially around the liquid separating device 101. More specifically, the desiccant bag 102 may be disposed to extend at least partially around the assembly of the pipes 120, 125 at a position beneath the flow deflector 115. The desiccant bag 102 and the liquid separating device 101 may have complimentary structure for securing a desired position of the desiccant bag 102 relative to the liquid separating device 101 and/or the can 41, such as providing a locating feature or coupling feature (such as a clip or the like) on the liquid separating device 101 and/or the can 41 for establishing a desired orientation and position of the desiccant bag 102 relative to the liquid separating device 101 and/or can 41.

As shown in FIGS. 4-6, an axial end portion 113 of the flow control structure 110 including edges disposed along portions of each of the inlet pathway 111 and the outlet pathway 112 thereof may be received within one or more coupling grooves 59 formed in the inner surface of the cap 42 partially defining an interior of the accumulator 32. The coupling grooves 59 are formed to include a shape corresponding to the edges disposed along the axial end portion 113 to cause the inner surface of the cap 42 to define an upper surface of each of the inlet pathway 111 and the outlet pathway 112 when the flow control structure 110 is coupled to the cap 42. In some embodiments, the flow control structure 110 and the cap 42 are each formed from metallic materials, such as aluminum, and the flow control structure 110 is brazed to the cap 42 following the reception of the axial end portion 113 of the flow control structure 110 within the coupling grooves 59. In other embodiments, the flow control structure 110 is formed from plastic and is press-fit into the coupling grooves 59 to couple the flow control structure 110 to the cap 42. As mentioned above, the flow control structure 110 may be coupled to the remainder of the liquid separating device 101 such that removal of the cap 42 will also result in the removal of the remainder of the liquid separating device 101 therefrom, and potentially the drying element 102 when the drying element 102 is located relative to or otherwise coupled to the liquid separating device 101.

As best shown throughout FIGS. 4-6, the internal heat exchanger 34 includes a plurality of heat exchanger plates stacked in a configuration for forming alternating first flow passages 61 and second flow passages 62 within the internal heat exchanger 34 with respect to a stacking direction of the plates. The first flow passages 61 are configured to receive the refrigerant along the high-pressure side of the internal heat exchanger 34 when flowing as a liquid while the second flow passages 62 are configured to receive the refrigerant along the low-pressure side of the internal heat exchanger 34 when flowing as a vapor or a combination of a vapor and liquid, depending on the circumstances. It is generally assumed hereinafter that the refrigerant entering the internal heat exchanger 34 along the low-pressure side is provided primarily as a vapor portion and includes a liquid portion in need of separation from the vapor portion within the described accumulator assembly 30.

The plurality of heat exchanger plates may be provided in any configuration allowing for the formation of alternating ones of the first flow passages 61 and the second flow passages 62 with respect to the stacking direction of the internal heat exchanger 34, which is the same as the axial direction of the accumulator assembly 30, for prescribing a desired degree of heat exchange communication between the refrigerant within the first flow passages 61 and the refrigerant within the second flow passages 62. The heat exchanger plates are also stacked in a configuration wherein the described heat exchange communication occurs without fluid communication also occurring between the first and second flow passages 61, 62, hence the first and second flow passages 61, 62 are fluidly distinct and decoupled from one another directly within the internal heat exchanger 34.

The plurality of the heat exchanger plates of the presently illustrated embodiment includes an outer cover plate 63, an oppositely arranged inner cover plate 64, and a stack of alternating first flow plates 71 and second flow plates 72 disposed axially between the outer and inner cover plates 63, 64. Each of the cover plates 63, 64 may be provided to include a greater thickness than each of the first and second flow plates 71, 72 to ensure a desired robustness of the internal heat exchanger 34 where coupled to the cap 42 and to external fluid lines associated with the adjacent components of the refrigerant circuit 10, such as by way of corresponding fluid couplings or fittings, as described hereinafter. In other embodiments, the first or second flow plates 71, 72 disposed at each axial end of the stack thereof may be adapted to act as one of the described cover plates 63, 64, as necessary, to couple the internal heat exchanger 34 to the cap 42 and any corresponding external fluid lines associated therewith.

The outer cover plate 63 includes a plurality of flow openings formed therethrough for conveying the refrigerant into or out of the internal heat exchanger 34 for flowing to or from one of the first or second flow passages 61, 62. The flow openings may include a liquid inlet opening 65 configured to receive a flow of the refrigerant as a liquid after exiting the condenser 13 along the high-pressure side of the refrigerant circuit 10, a liquid outlet opening 66 configured to deliver the liquid refrigerant from the internal heat exchanger 34 to flow towards a corresponding expansion element 14, 15 along the high-pressure side of the refrigerant circuit 10, a vapor inlet opening 67 configured to receive a flow of the combined vapor and liquid refrigerant after having flowed through one of the corresponding evaporators/chillers 20, 22 along the low-pressure side of the refrigerant circuit 10, and a vapor outlet opening 68 configured to deliver the refrigerant as a vapor after having separated the liquid portion from the refrigerant within the can 41 of the accumulator assembly 30 along the low-pressure side of the refrigerant circuit 10.

Each of the flow openings 65, 66, 67, 68 formed in the outer cover plate 63 is further associated with a corresponding fluid coupling or fitting configured to form a fluid connection and fluid tight seal with a corresponding fluid line extending upstream or downstream of each of the identified flow openings 65, 66, 67, 68 with respect to the flow of the refrigerant through the refrigerant circuit 10, as may be determined from review of the refrigerant circuit 10 as shown in FIG. 1. Specifically, a liquid inlet fitting 165 is associated with the liquid inlet opening 65, a liquid outlet fitting 166 is associated with the liquid outlet opening 66, a vapor inlet fitting 167 is associated with the vapor inlet opening 67, and a vapor outlet fitting 168 is associated with the vapor outlet opening 68. Each of the fluid couplings or fittings 165, 166, 167, 168 may include structure extending circumferentially around the corresponding flow opening 65, 66, 67, 68 of the outer cover plate 63 that is aggressively joined to the outer cover plate 63 about a perimeter of each of the flow openings 65, 66, 67, 68.

Each of the fluid couplings or fittings 165, 166, 167, 168 is shown in FIGS. 2-7 as a female block seal fitting configured to mate with a corresponding male block fitting (not shown) disposed at an end of each respective fluid line extending to or from one of the fluid couplings or fittings. Specifically, each block fitting assembly includes the insertion of a projecting portion of the corresponding male block seal fitting having a flow opening therethrough into a recessed portion of an associated female block seal fitting also having a flow opening formed therethrough, wherein a sealing element is compressed between the projecting portion and the recessed portion to establish a fluid tight seal about each of the aligned flow openings of the male and female block seal fittings. A threaded fastener (not shown) may be utilized for joining each pairing of male and female block seat fittings and for attaining a desired degree of compression of the corresponding sealing element via appropriate threading of the fastener through each of the block fittings. Each of the female block seal fittings 165, 166, 167, 168 shown throughout the present figures is coupled directly to the outer cover plate 63 via an aggressive joining process, such as welding or brazing, to form a desired fluid tight connection and seal where each female block seal fitting 165, 166, 167, 168 is coupled to the outer cover plate 63 to surround one of the described flow openings 65, 66, 67, 68 through the outer cover plate 63. However, it should be readily apparent to one skilled in the art that substantially any form of fluid coupling or fitting allowing for a coupling of a fluid line to the outer cover plate 63 of the internal heat exchanger 34 may be utilized while remaining within the scope of the present invention.

The inner cover plate 64 includes a vapor outlet opening 91 and a vapor inlet opening 92 formed therein. The vapor outlet opening 91 of the inner cover plate 64 is axially aligned with the vapor inlet opening 67 of the outer cover plate 63 and a flow conduit 93 extends axially therebetween. The flow conduit 93 is formed by a cylindrical structure extending between the vapor inlet and outlet openings 67, 91 of the opposing cover plates 63, 64 for conveying the vapor and liquid refrigerant to the accumulator 32 along a direct and axially extending flow path. The flow conduit 93 may be provided in a manner wherein substantial heat exchange does not occur between the refrigerant entering the accumulator 32 via the flow conduit 93 and the refrigerant flowing through the first and second flow passages 61, 62, each of which are delimited laterally by the outer surface of the flow conduit 93. A conduit opening 94 is formed through each of the first flow plates 71 and each of the second flow plates 72 with the conduit openings 94 axially aligned to receive the flow conduit 93 therethrough. The flow conduit 93 may be aggressively joined to the perimeter of each of the conduit openings 94 by brazing to fluidly seal each joint of the flow conduit 93 with one of the first or second flow plates 71, 72. The vapor inlet opening 92 of the inner cover plate 64 is configured to receive the refrigerant as a vapor having had the liquid portion thereof separated out within the accumulator 32 with the vapor entering the second flow passages 62 formed within the internal heat exchanger 34.

The cap 42 includes a first pass-through opening 97 formed therethrough from an outer surface to an inner surface thereof with the first pass-through opening 97 axially aligned with the vapor outlet opening 91 of the adjacent disposed inner cover plate 64. As shown in FIG. 4, the flow conduit 93 may extend axially at least partially into the first pass-through opening 97. The first pass-through opening 97 is configured to fluidly couple the inlet pathway 111 of the liquid separating device 101 of the accumulator 32 to the interior of the flow conduit 93, or to allow for passage of the refrigerant through the cap 42 in the axial direction by way of the flow conduit 93 extending through the first pass-through opening 97.

Both the first flow plates 71 and the second flow plates 72 include a plurality of manifold openings formed therethrough for forming refrigerant manifolds within the internal heat exchanger. Each of the first flow plates 71 and each of the second flow plates 72 include each of a liquid inlet manifold opening 81, a liquid outlet manifold opening 82, a vapor inlet manifold opening 83, and a vapor outlet manifold opening 84 formed therein. When the first and second flow plates 71, 72 are arranged in the stack, the liquid inlet manifold openings 81 are axially aligned with one another to form a liquid inlet manifold 85, the liquid outlet manifold openings 82 are axially aligned with one another to form a liquid outlet manifold 86, the vapor inlet manifold openings 83 are axially aligned with one another to form a vapor inlet manifold 87, and the vapor outlet manifold openings 84 are axially aligned with one another to form a vapor outlet manifold 88. The first flow passages 61 provide fluid communication between the liquid inlet manifold 85 and the liquid outlet manifold 86 with respect to the high-pressure side of the internal heat exchanger 34 and the second flow passages 62 provide fluid communication between the vapor inlet manifold 87 and the vapor outlet manifold 88 with respect to the low-pressure side of the internal heat exchanger 34. The liquid inlet manifold 85 is axially aligned with and fluidly coupled to the liquid inlet opening 65 of the outer cover plate 63, the liquid outlet manifold 86 is axially aligned with and fluidly coupled to the liquid outlet opening 66 of the outer cover plate 63, the vapor inlet manifold 87 is axially aligned with and fluidly coupled to the vapor inlet opening 92 of the inner cover plate 64, and the vapor outlet manifold 88 is axially aligned with and fluidly coupled to the vapor outlet opening 68 of the outer cover plate 63.

The cap 42 further includes a second pass-through opening 98 configured to fluidly couple the outlet pathway 112 of the liquid separating device 101 to the vapor inlet manifold 87 of the internal heat exchanger 34. The second pass-through opening 98 accordingly provides fluid communication between the interior of the can 41 and the interior of the internal heat exchanger 34 as formed by the second flow passages 62.

A flow of the liquid refrigerant through the high-pressure side accordingly includes the liquid refrigerant flowing through the liquid inlet opening 85 of the outer cover plate 63, the liquid inlet manifold 85, the first flow passages 61, the liquid outlet manifold 86, and the liquid outlet opening 66 of the outer cover plate 63. A flow of the vapor refrigerant through the low-pressure side accordingly includes the vapor refrigerant, following separation of the liquid portion therefrom within the accumulator 32 and passage through the outlet pathway 112 of the flow control structure 110 disposed within the accumulator 32, flowing through the second pass-through opening 98 of the cap 42, the vapor inlet opening 92 of the inner cover plate 64, the vapor inlet manifold 87, the second flow passages 62, the vapor outlet manifold 88, and the vapor outlet opening 68 of the outer cover plate 63.

In the present embodiment, both the first and second flow plates 71, 72 include a tapered perimeter portion forming a frustoconical shape for nesting adjacent ones of the alternating first and second flow plates 71, 72 relative to one another while spacing the relevant features of the first and second flow plates 71, 72 from one another with respect to the stacking direction for establishing the open spaces forming the first and second flow passages 61, 62 therein. Each of the first flow plates 71 includes a first face facing axially towards the outer cover plate 63 and an oppositely arranged second face facing axially towards the inner cover plate 64 while each of the second flow plates 72 similarly includes a first face facing axially towards the outer cover plate 63 and an oppositely arranged second face facing axially towards the inner cover plate 64. The alternating stacking of the first and second flow plates 71, 72 results in each of the first flow passages 61 being formed by an open space formed between the second face of one of the first flow plates 71 and the first face of an adjacent disposed one of the second flow plates 72 and each of the second flow passages 62 being formed by an open space formed between the first face of one of the first flow plates 71 and the second face of an adjacent disposed one of the second flow plates 72. Each of the described manifolds 85, 86, 87, 88 includes a connecting portion of one of the first flow plates 71 or one of the second flow plates 72 bent out of plane to connect to an adjacent one of the first plates 71 or second plates 72 about a perimeter of the corresponding manifold 85, 86, 87, 88 to maintain separation of the first flow passages 61 and the second flow passages 62 at each of the manifolds 85, 86, 87, 88.

Figure 3:
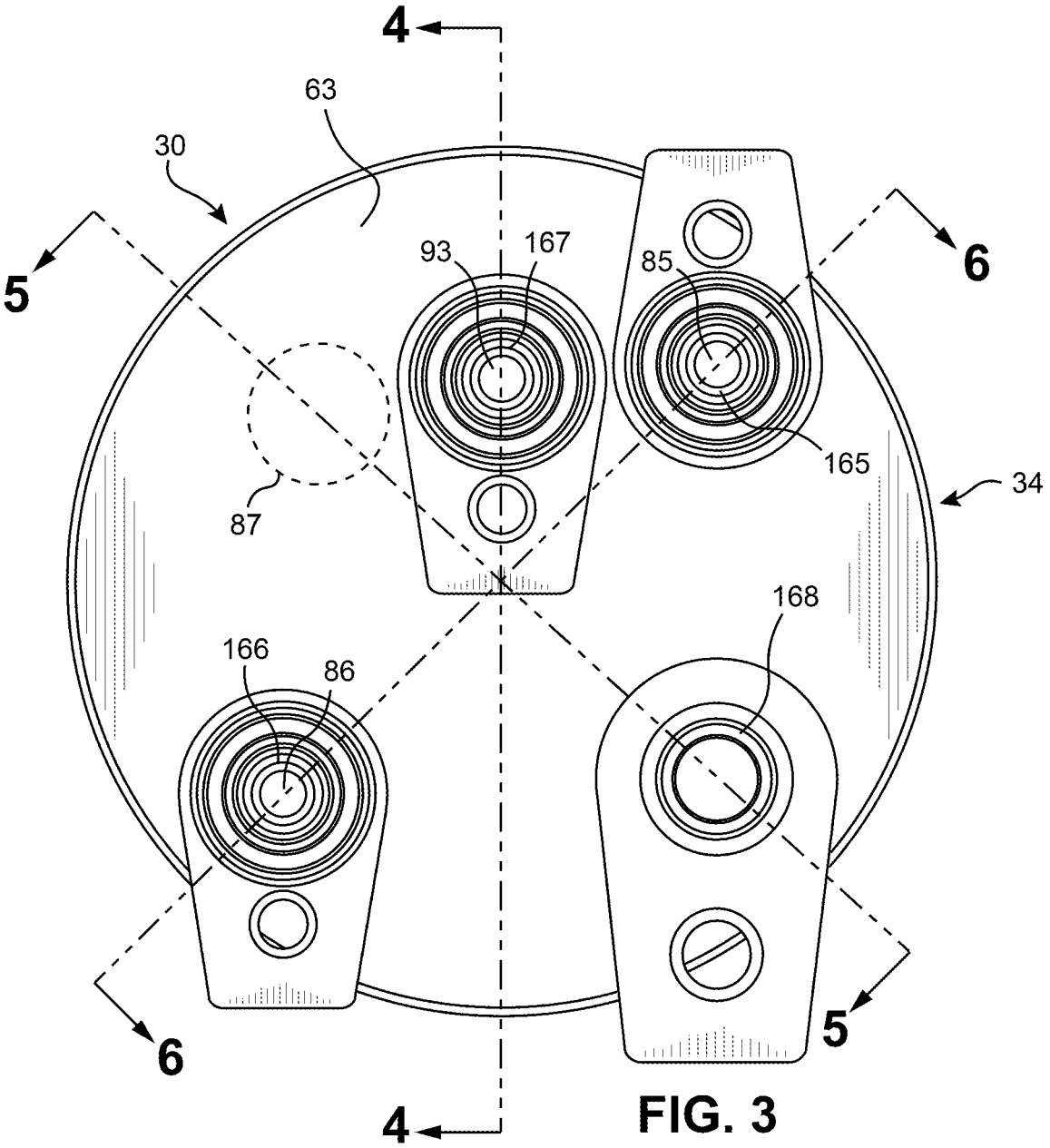
FIG. 3 is a top plan view of the integrated accumulator and internal heat exchanger.

As can be seen from the perspective of FIG. 3, the described configuration of the internal heat exchanger 34 includes the liquid inlet manifold 85 (corresponding to the position of the liquid inlet fitting 165) and the liquid outlet manifold 86 (corresponding to the position of the liquid outlet fitting 166) being disposed towards diametrically opposing sides of the internal heat exchanger 34 along a first axis arranged perpendicular to the axial direction of the accumulator assembly 30, and the vapor inlet manifold 87 (shown in broken line form in FIG. 2) and the vapor outlet manifold 88 (corresponding to the position of the vapor outlet fitting 168) being disposed towards diametrically opposing sides of the internal heat exchanger 34 along a second axis arranged perpendicular to the axial direction of the accumulator assembly 30 and the previously described first axis. The described configuration results in the liquid refrigerant and the vapor refrigerant flowing perpendicular to one another when exchanging heat with one another when traversing the respective first flow passages 61 and the second flow passages 62, which may be referred to as a cross-flow flow configuration of the internal heat exchanger 34.

FIG. 3 also shows the flow conduit 93 for passing the refrigerant through the internal heat exchanger 34 and to the accumulator 32 as being offset from a central axis of the accumulator assembly 30 to aid the refrigerant in flowing in the helical or spiral flow configuration when entering the inlet pathway 111 of the flow control structure 110. However, when an alternative form of an accumulator other than the described cyclone type is utilized, the flow conduit 93 and the associated vapor inlet opening 67 may instead be positioned directly along a central axis of the accumulator assembly 30.

As mentioned previously, the configuration of the internal heat exchanger 34 shown in FIGS. 2-7 is not to be considered limiting, as alternative stacked plate configurations may be utilized in forming the first and second flow passages 61, 62 while remaining within the scope of the present invention, so long as the internal heat exchanger 34 is able to be integrated into the structure of the removable cap 42 in the manner described herein for appreciating the described benefits of the accumulator assembly 30. For example, one possible alternative configuration of the flow plates may include the first flow plates 71 and the second flow plates 72 being substantially identical in form and configuration with alternating ones of the first and second flow plates 71, 72 being reversed in orientation to face in opposing axial directions.

Figure 9:
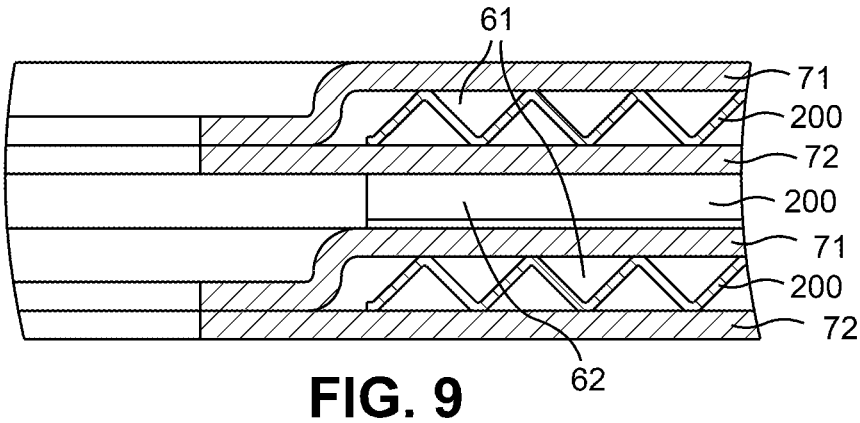
FIG. 9 is an enlarged fragmentary cross-sectional view showing corrugated fins implemented within the flow passages formed within the internal heat exchanger of FIGS. 2-6.

Referring now to FIG. 9, the internal heat exchanger 34 may include the addition of surface area increasing features for aiding in transferring heat between the low-pressure and high-pressure flows thereof. Specifically, the internal heat exchanger 34 may be provided as a plate-fin (PF) heat exchanger having corrugated fins 200 disposed within one or both of the flow passages 61, 62. Each of the fins 200 may be arranged within a corresponding flow passage 61, 62 to include the corrugations thereof extending in the direction of flow of the refrigerant through the respective flow passage 61, 62. The cross-flow configuration of the internal heat exchanger 34 accordingly includes the fins 200 extending in perpendicular arranged directions when disposed through the first flow passages 61 and the second flow passages 62. The fins 200 are omitted from FIGS. 4-6 to better show the remaining features of the internal heat exchanger 34, but the fins 200 may be provided at any desired position within one of the flow passages 61, 62 for increasing the heat exchange capacity of the internal heat exchanger 34 in accordance with the disclosure of the present invention.

Figure 10:
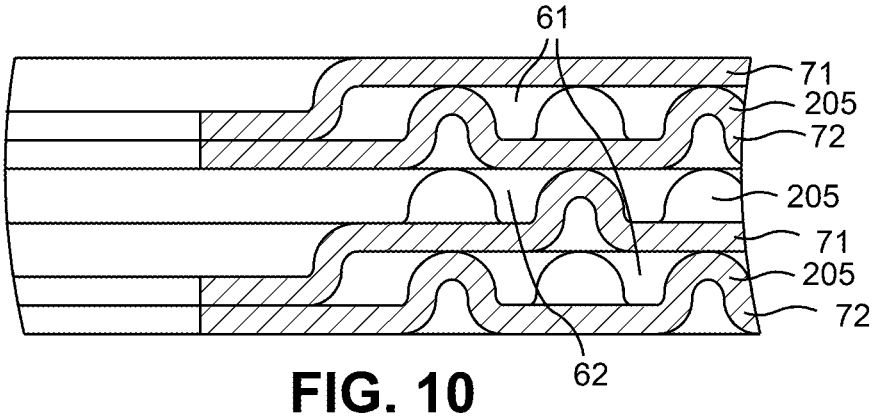
FIG. 10 is an enlarged fragmentary cross-sectional view showing dimples implemented within the flow passages formed within the internal heat exchanger of FIGS. 2-6.

FIG. 10 illustrates an additional surface area increasing feature in the form of a plurality of dimples 205 formed in the first plates 71 and second plates 72 for increasing the surface area of the plates 71, 72 extending into each of the flow passages 61, 62. The dimples 205 may also aid in introducing turbulence into the refrigerant when passing thereby, which aids in further enhancing the heat exchanging capacity of the internal heat exchanger 34. The dimples 205 may be provided in an alternating offset arrangement to prescribe a desired flow of the refrigerant around the dimples 205. The dimples 205 may extend across a height of each of the flow passages 61, 62 (as shown) or may extend only partially across a height of each of the flow passages 61, 62. In some embodiments, the fins 200 may be added to a structure further including a pattern of the dimples 205 formed therein, as desired.

Although not pictured, the accumulator assembly 30 may include a contrary flow configuration of the refrigerant entering the accumulator assembly 30 as the combined liquid and vapor portions thereof. Specifically, the flow conduit 93 shown and described as being associated with passing the refrigerant through the internal heat exchanger 34 for entry into the accumulator 32 may instead be placed within a corresponding passage aligned with the outlet pathway 112 of the flow control structure 110 while an outlet manifold of the internal heat exchanger 34 in fluid communication with the second passages 62 and for conveying the refrigerant to the inlet pathway 111 of the flow control structure 110 may be axially aligned therewith. That is, the depiction of the internal heat exchanger 34 in FIG. 4 may be substantially substituted for the depiction of the internal heat exchanger 34 in FIG. 5 while maintaining the same configuration of the accumulator 32, thereby reversing the order of flow of the refrigerant with respect to the interior 45 of the can 41 and the interior of the internal heat exchanger 34. Specifically, such a configuration includes the heat exchange occurring within the internal heat exchanger 34 prior to the separation of the liquid portion from the vapor portion within the accumulator 32, which is in contrast to the configuration of FIGS. 4 and 5.

The accumulator assembly 30 as shown and described presents multiple beneficial features. First, the manner in which the internal heat exchanger 34 is integrated into the cap 42 removes multiple additional fluid couplings and fittings from the refrigerant circuit 10 via the removal of the fluid lines normally present between the accumulator and the internal heat exchanger. The use of the flow conduit 93 as a pass-through for the vapor refrigerant entering the accumulator 32 also aids in placing all necessary fluid couplings and fittings along a common structure at an axial end of the removal cap and heat exchanger structure. The ability to remove the cap 42 from the can 41 allows for access into the interior 45 of the can 41 for any form of desired repair, cleaning, maintenance, replacement, or other servicing of any of the components disposed therein, including attention being given to the liquid separating device 101 and/or the drying element 102. The can 41 is accordingly able to be left in place when the remainder of the accumulator assembly 30 is removed therefrom. Specifically, when in service, the cap 42 can be removed, and the desiccant bag 102 can be replaced without removing the entire accumulator assembly 30 from the vehicle.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An accumulator and heat exchanger assembly comprising:

a heat exchanger including first flow passages and second flow passages formed therein, the first flow passages configured to convey a first fluid flow therethrough and the second flow passages configured to convey a second fluid flow therethrough with the first fluid flow and the second fluid flow fluidly separated from one another within the heat exchanger; and an accumulator including a can and a cap removably coupled to the can, an interior of the can configured to convey the second fluid flow therethrough to separate a liquid portion thereof from a vapor portion thereof and/or to remove moisture therefrom, wherein the heat exchanger is coupled to the cap and is removable from the can therewith, wherein removal of the cap and the heat exchanger from the can provides access to the interior of the can, wherein the heat exchanger includes a stack of heat exchanger plates with the first flow passages and the second flow passages formed between adjacent ones of the heat exchanger plates, and wherein a fluid conduit extends through the first flow passages and the second flow passages of the heat exchanger by penetrating the heat exchanger plates, the fluid conduit configured to convey the second fluid flow to the interior of the can.

2. The accumulator and heat exchanger assembly of claim 1, wherein the cap is removably coupled to the can via threaded engagement therebetween.

3. The accumulator and heat exchanger assembly of claim 2, wherein the can includes an annular collar coupled to a circumferential wall of the can, and wherein the collar includes a threaded portion of the can configured to threadably engage a threaded portion of the cap.

4. The accumulator and heat exchanger assembly of claim 3, wherein the collar is aggressively joined to an end surface of the circumferential wall via brazing or welding.

5. The accumulator and heat exchanger assembly of claim 3, wherein the threaded portion of the can is formed within the collar prior to a coupling of the collar to the circumferential wall of the can.

6. The accumulator and heat exchanger assembly of claim 1, wherein a liquid separating device is disposed within the interior of the can to separate the liquid portion of the second fluid flow from the vapor portion thereof.

7. The accumulator and heat exchanger assembly of claim 6, wherein the liquid separating device includes a flow control structure coupled directly to an inner surface of the cap.

8. The accumulator and heat exchanger assembly of claim 7, wherein an axial end portion of the flow control structure is received within at least one groove formed in the inner surface of the cap.

9. The accumulator and heat exchanger assembly of claim 1, wherein a drying element is disposed within the interior of the can to remove moisture from the second fluid flow.

10. The accumulator and heat exchanger assembly of claim 9, wherein the drying element is a removable desiccant bag.

11. The accumulator and heat exchanger assembly of claim 1, wherein a corrugated fin is disposed within one of the first flow passages and/or one of the second flow passages.

12. The accumulator and heat exchanger assembly of claim 1, wherein a pass-through opening formed through the cap provides fluid communication between the interior of the can and the second flow passages of the heat exchanger with respect to the second fluid flow.

13. The accumulator and heat exchanger assembly of claim 1, wherein one of the heat exchanger plates of the heat exchanger is coupled directly to the cap.

14. The accumulator and heat exchanger assembly of claim 1, wherein the one of the heat exchanger plates is aggressively joined to the cap via one of brazing or welding.

15. The accumulator and heat exchanger assembly of claim 1, wherein the heat exchanger includes a cover plate including an inlet opening of the first fluid flow, an outlet opening of the first fluid flow, an inlet opening of the second fluid flow, and an outlet opening of the second fluid flow.

16. The accumulator and heat exchanger assembly of claim 1, wherein first fluid flow is a high-pressure flow of a refrigerant and the second fluid flow is a low-pressure flow of the refrigerant.

17. The accumulator and heat exchanger assembly of claim 16, wherein the heat exchanger is an internal heat exchanger of a refrigerant circuit.

18. A thermal management system comprising:

a refrigerant circuit including, in an order of flow of a refrigerant through the refrigerant circuit, a compressor, a condenser, a high-pressure side of an internal heat exchanger, an expansion element, an evaporator, an accumulator, and a low-pressure side of the internal heat exchanger, wherein the high-pressure side of the internal heat exchanger includes first flow passages formed therein and the low-pressure side of the internal heat exchanger includes second flow passages formed therein, wherein the first flow passages are configured to convey a first flow of the refrigerant therethrough and the second flow passages are configured to convey a second flow of the refrigerant therethrough, wherein the first flow of the refrigerant and the second flow of the refrigerant are fluidly distinct from one another within the internal heat exchanger; and wherein the accumulator includes a can and a cap removably coupled to the can, wherein an interior of the can is configured to convey the second flow of the refrigerant therethrough to separate a liquid portion thereof from a vapor portion thereof and/or to remove moisture therefrom, wherein the internal heat exchanger is coupled to the cap and is removable from the can therewith, wherein removal of the cap and the internal heat exchanger from the can provides access to the interior of the can, wherein the heat exchanger includes a stack of heat exchanger plates with the first flow passages and the second flow passages formed between adjacent ones of the heat exchanger plates, and wherein a fluid conduit extends through the first flow passages and the second flow passages of the heat exchanger by penetrating the heat exchanger plates, the fluid conduit configured to convey the second fluid flow to the interior of the can.

* * * * *